United States Patent [19]

Eventoff et al.

[11] 4,268,815

[45] May 19, 1981

[54] MULTI-FUNCTION TOUCH SWITCH APPARATUS

[76] Inventors: Franklin N. Eventoff, 2351 Lake View Ave., Los Angeles, Calif. 90039; M. Tyrone Christiansen, 629 N. Rossmore Ave., Los Angeles, Calif. 90004

[21] Appl. No.: 97,610

[22] Filed: Nov. 26, 1979

[51] Int. Cl.[3] ..... H01C 10/10; H01C 10/12

[52] U.S. Cl. ..... 338/69; 84/DIG. 7; 338/99; 338/114

[58] Field of Search ..... 338/69, 99, 110, 114; 200/5 R, 18, 86 A, 86.5, 159, 307; 84/DIG. 7, 1.17, 1.24

[56] References Cited

U.S. PATENT DOCUMENTS

| | | | |
|---|---|---|---|
| 1,926,419 | 9/1933 | Apple | 338/110 |
| 3,626,350 | 12/1971 | Suzuki et al. | 338/69 |
| 3,917,917 | 11/1975 | Murata | 200/5 R X |
| 3,960,044 | 6/1976 | Nagai et al. | 338/114 X |

FOREIGN PATENT DOCUMENTS 1520899 8/1978 United Kingdom .

*Primary Examiner*—C. L. Albritton
*Attorney, Agent, or Firm*—Nilsson, Robbins, Dalgarn, Berliner, Carson & Wurst

[57] ABSTRACT

A multi-function touch switch apparatus has a first semiconductor composition layer disposed on top of a first conductor layer which is affixed to a first base member. A second semiconductor composition layer opposing the first semiconductor in spaced relationship thereto is disposed on a second conductor layer which is itself disposed on the bottom surface of a second support member. A third conductor layer is also disposed on the top surface of the second support member in opposing spaced-apart relationship to a fourth conductor layer disposed on the bottom surface of a third support member. The second and third support members and the affixed conductor layers and semiconductor layers are resiliently deformable in a transverse axis in response to a transverse touch force to thereby cause electrical contact between the second and third conductor layers to provide a closed switch and the first and second semiconductor layers to provide a closed switch in series with a pressure sensitive resistance.

6 Claims, 2 Drawing Figures

MULTI-FUNCTION TOUCH SWITCH APPARATUS

BACKGROUND OF THE INVENTION

The present invention relates to touch switch devices and in particular to multiple stacked touch switches which may be simultaneously closed by the application of a single transverse touching force.

Switching devices which are operable in response to application of a transverse touching force are well known. Frequently, however, it is desirable to perform several independent switching functions simultaneously upon the application of a single transverse touch force. For example, battery-powered musical instruments have recently been developed wherein keyboards consist of touch-sensitive switches interconnected in resistive networks to thereby replace strings or keys utilized on conventional instruments. In such instruments it is frequently desirable to use metal oxide semiconductor technology (MOS). However, as is well known, MOS circuitry requires substantial amounts of power even if an input signal has been entirely disconnected by the opening of a switch. Hence, batteries are quickly drained of power and require frequent replacement even when the instrument has not been played but is on.

It is therefore desirable to provide a dual or multi-function switch which will perform the function of both connecting power to the circuitry and connecting or applying the input signal to the circuitry only when the touch-sensitive switch is depressed by a transverse touching force.

In another embodiment of the invention a semiconductor composition layer can be disposed on one or more of the contact surfaces of one or more of the stacked switches to thereby interpose a resistance in series with the switch. The resistance in a preferred embodiment will be variable in response to variations in the transverse touching force.

SUMMARY OF THE INVENTION

The present invention is a multi-function touch switch apparatus comprising a plurality of juxtaposed touch switches in a unitary stacked configuration for being closed in response to a single transverse touching force. Each touch switch in the stacked configuration comprises a first conductor and a second conductor. The second conductor is juxtaposed opposite the first conductor in a spaced-apart, normally opened switch relationship wherein at least one of the first and second conductors is resiliently deformable into electrically contacting relationship to the other of the first and second conductors by the transverse touching force. Each of the juxtaposed stacked touch switches may thus be electrically isolated from the remaining touch switches.

In the preferred embodiment, at least one of the first and second conductors of at least one of the stacked switches comprises a conductor layer with a semiconductor composition layer covering the conductor layer so that the semiconductor composition layer faces the other of the first and second conductors for being contacted thereby when the transverse touch force is applied.

The semiconductor composition layers are preferably responsive to variations in the amount of applied transverse touch force for decreasing the contact resistance across the surface of the semiconductor composition layer as the transverse touch force is increased.

BRIEF DESCRIPTION OF THE DRAWINGS

A complete understanding of the present invention and of the above and other advantages thereof may be gained from a consideration of the following description of the preferred embodiments taken in conjunction with the accompanying drawings in which.

DETAILED DESCRIPTION

Many types of electrical circuit components, such as MOS circuitry, are known to continue to draw substantial amounts of electrical power even when the input to the circuitry has been disconnected by, for example, a switch. This power drain presents a serious problem in battery-powered devices. The present invention solves this problem by providing a novel dual-function, touch-switch apparatus which not only couples or decouples the input signal from the MOS circuit, but simultaneously couples or decouples power to the circuit components so that they do not draw any power.

Figure 1:
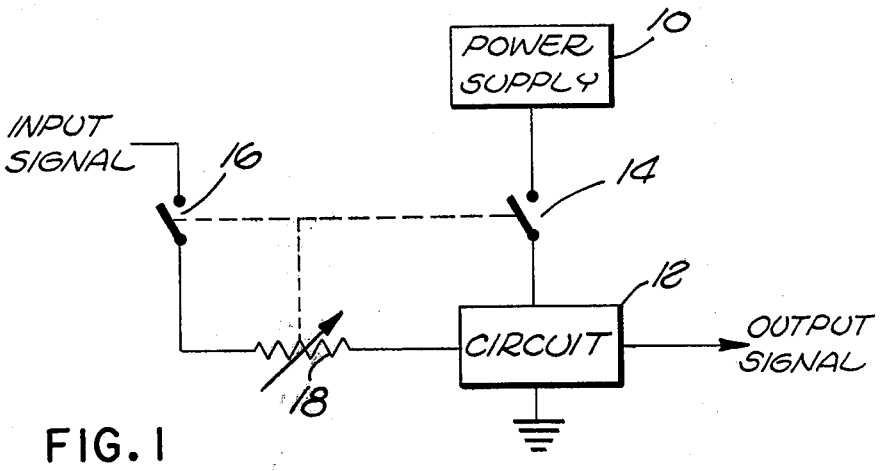
FIG. 1 is a generalized schematic representation illustrating the operation of a dual stacked switch embodiment of the present invention.

The above described functional problem solved by the present invention is illustrated in FIG. 1 where as power supply 10 is coupled to provide power to the circuit 12 which operates on an input signal to generate an output signal. A switch 14 coupled between the power supply 10 and the circuit 12 may be opened or closed to disconnect or connect power to the circuit 12. Similarly, another switch 16 coupled in the input lead of the circuit 12 either connects or disconnects the input signal to the circuit 12. In order to accomplish the goal of the present invention, the switch 14 and the switch 16 are operationally interconnected in such a way that both switches 14 and 16 open or close in response to a single applied force. A pressure sensitive semiconductor composition may be applied to the contacts of the switch 16 to provide a pressure sensitive variable resistance 18 in series with the switch 16.

Figure 2:
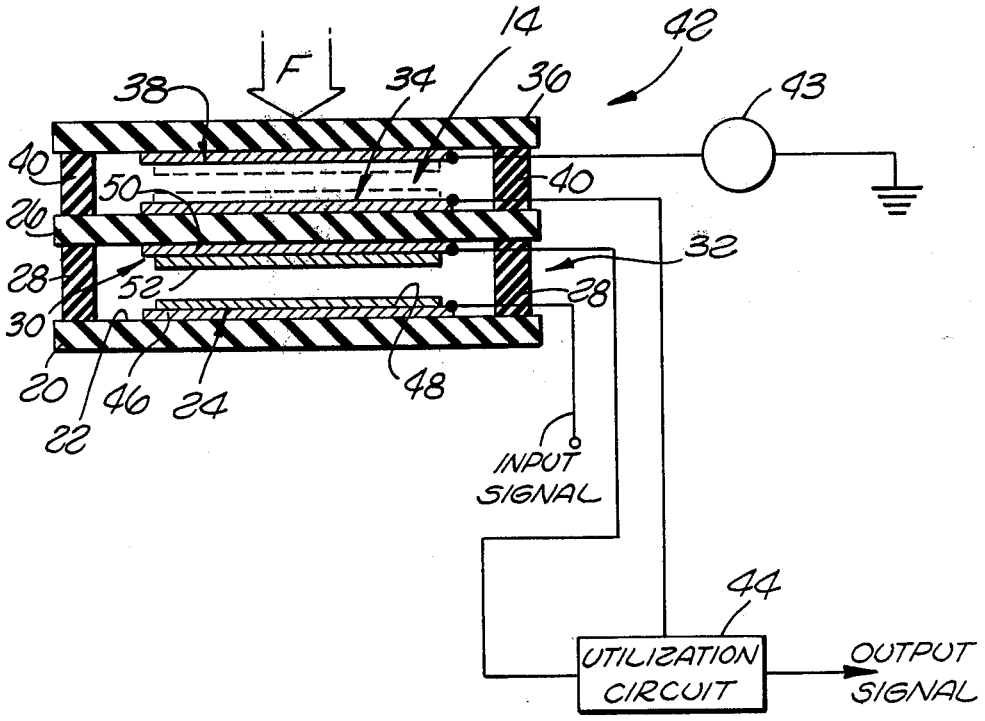
FIG. 2 is a cut-away side plan view of a dual-function, touch-switch apparatus in accordance with the invention.

Referring to FIG. 2, the novel function, touch-switch apparatus has a first support member 20 made of an insulative material which may be flexible or rigid. The first support member 20 has a top surface 22 on which a first conductor ply 24 is disposed. The first conductor ply 24 may, for example, be a copper plate or a silver surface or any other suitable conductor disposed on the top surface 22 of the first support member 20 in any suitable manner such as spraying or plating.

A second support member 26, also made of insulative material is spaced above the first support member 20 by first spacers 28. A second conductor ply 30 is positioned or otherwise affixed to the bottom surface of the second support member 26 facing but in spaced apart relationship to the first conductor ply 24. The second support member 26 is made of a material which is resiliently deformable so that the second conductor ply 30 can be depressed into contact with the first conductor ply 24 by the application of a transverse force F. Thus, the movement of the second conductor ply 30 into contact with the first conductor ply in response to an applied transverse force 32 provides a first touch switch 32.

A second touch switch 42 which is also operable in response to the same transverse force F is incorporated by providing a third conductor ply 34 on the top surface of the second support member 26. A third support member, which is also made of a resiliently deformable material, is spaced above the third conductor ply 34 by second spacers 40. A fourth conductor ply 38 is affixed on the bottom surface of a third support member 36 facing, but spaced apart from, the third conductor ply 34 in a normally opened, i.e., non-conducting, relationship. The third support member 36, and hence the fourth conductor ply 38, is spaced apart from the second support member 26, and hence the third conductor ply 34, by the second spacers 40 which may then surround or be disposed on opposite sides of the respective third and fourth conductor piles 34 and 38.

In operation, the application of the transverse force F, which may be applied by simply pressing against the top surface of the third support member 36, causes the third support member 36 and the fourth conductor ply 38 to be resiliently deformed into electrical conducting contact with the third conductor ply 34 to thereby close the second switch 42 coupled between a power source 43 and the power supply input of a utilization circuit 44. As additional transverse touch force F is applied, the second support member, and hence the third conductor ply 34 and the second conductor ply 30 are resiliently deformed so that the second conductor ply 30 is brought into electrically contacting relationship with the first conductor ply 24 to thereby close the first switch 32 to thus couple an input signal to the utilization circuit 44.

In a basic embodiment of the present invention, the first, second, third, and fourth conductor plies, 24, 30, 34, and 38, each comprise simply a conductive layer or plate disposed on the appropriate first, second, or third support members 20, 26, or 36. The conductive layer as previously mentioned may be of any suitable material such as copper or silver and may be disposed or otherwise attached on the appropriate surface of the first, second, or third support members 20, 26, or 36 by any suitable means such as spraying, silk screening, vacuum deposition, electrostatic plating, or any other suitable method.

In an alternative, preferred embodiment, however, at least one of the first and second conductor plies 24 and 30 comprises a conductive layer on top of which is disposed a layer of semiconductor material to thereby couple a resistance in series with the switch. Referring more specifically to FIG. 2, the first conductor means 24 may, for example, comprise a first conductive layer 46 made of silver, copper, or other similar conductive material as previously described, positioned and attached directly to the top surface of the first support member 20. A first semiconductor composition layer 48 is then disposed on the exposed surface of the first conductive layer 46 in the manner described in patent application, Ser. No. 78,323, filed Sept. 24, 1979, which is herein incorporated by reference. Similarly, the second conductor ply 30 may include a second conductive layer 50 covered by a second semiconductor composition layer 52. The semiconductor layers 48 and 52 may be silk screened, sprayed, or otherwise disposed.

In the preferred embodiment, the semiconductor composition layers are made of a molybdenum disulfide and binder mixture where the binder may be a suitable resin. Of course, any other suitable resistive material may also be used. In addition, in the preferred embodiment, the semiconductor layer is silk screened or sprayed on so that only a very thin coating, on the order of 0.001 inch or less, is applied. An additional advantage of the present invention is that as additional transverse force F is applied, more contact points will be made between the semiconductor layer 52 and the semiconductor layer 48 thus decreasing the contact surface resistance between the two semiconductor layers 48 and 52. Hence, the present invention, in the preferred embodiment provides not only dual switches operable in response to a single touch force, but also provides a pressure sensitive variable resistance in series with either one or both switches.

It will be appreciated, of course, that one or both of the third and fourth conductor plies 34 and 38 may also incorporate a semiconductor top surface layer to provide an additional variable resistance across the switch 42.

Although the switches 32 and 42 of the present dual function touch switch apparatus previously disclosed, are closed substantially simultaneously, it will be appreciated that there will, in fact, be a very small delay between the time that the fourth conductor ply 38 contacts the third conductor ply 34 and the time the second conductor ply 30 contacts the first conductor ply 24. This very slight delay allows the power to be applied to the utilization circuit 44 prior to application of the input signal to the utilization circuit 44. This allows the various circuit components to be substantially fully powered and thus operational prior to the connection of input signal. In sum, therefore, although the closing of the switches 32 and 42 are almost simultaneous, there will be a slight delay which is advantageously used to allow the utilization circuit components to achieve full power prior to applying the input signal.

Of course, it will be appreciated that the present dual-function, touch switch apparatus may be configured in any number of different ways without departing from the scope and spirit of the present invention. Thus, although the invention has been specifically described in conjunction with a dual-function touch switch it will be appreciated that more than two switches may be stacked on top of one another in a unitary touch switch apparatus to thereby provide a multi-function touch switch apparatus without departing from the spirit of the present invention. Each such additional touch switch device may be configured in the manner previously described in conjunction with the two touch switches of the dual-function touch switch embodiment of the invention.

What is claimed is:

1. A dual function, touch switch apparatus comprising, in stacked configuration:

a first support member having a top surface;

a first conductor ply positioned on the top surface of the first support member;

a second support member having a bottom surface facing the top surface of the first support member and having a top surface, the second support member being spaced from the first support member;

a second conductor ply juxtaposed opposite the first conductor ply and affixed on the bottom surface of the second support member, in normally spaced-apart relationship for defining a first switch;

at least one of the first and second conductor plies, comprising:

a first conductor layer attached to the adjacent one of the first and second support members, and a first semiconductor layer affixed on the first conductor layer and juxtaposed opposite the spaced-apart other of the first and second support members;

a third conductor ply on the top surface of the second support member;

a third support member having a top surface and a bottom surface facing but spaced from the top surface of the second support member; and a fourth conductor ply on the bottom surface of the third support member and juxtaposed opposite the third conductor ply in normally spaced-apart relationship thereto for defining a second switch, at least the second and third support members being resiliently deformable in response to the application of a transverse force for making electrical contact between the first and second conductor plies and between the third and fourth conductor plies.

2. The dual function, touch switch apparatus of claim 1 wherein at least one of the third and fourth conductors comprises:

a second conductor layer; and a second semiconductor composition layer in permanent contacting relationship to the second conductor layer, the conductor layer being between the adjacent one of the second and third support members and the second semiconductor composition layer.

3. The dual-function touch switch apparatus of claims 1 or 2 for being coupled to a signal source for supplying an input signal, the switch apparatus further comprising:

a power supply; and a utilization circuit coupled to the power supply for providing power to the utilization circuit, the second switch coupled in series between the utilization circuit and the power supply for supplying power to the utilization circuit, the first switch being coupled in series between the signal source and the utilization circuit, the first switch selectively enabling the input signal for being operated on by the utilization circuit to generate an output signal.

4. The dual function, touch switch apparatus of claims 1 or 2 wherein the first semiconductor composition layers are responsive to variations in the applied transverse touch force for decreasing the contact resistance across the surface of the semiconductor composition layer as the transverse touch force is increased.

5. A multi-function touch switch apparatus comprising a plurality of juxtaposed touch switches in a vertically stacked configuration for being closed in response to a single vertically applied transverse touch force, each touch switch comprising:

a first conductor ply; and a second conductor ply juxtaposed opposite the first conductor ply in normally spaced-apart relationship thereto, at least one of the first and second conductor plies being resiliently deformable into electrically contacting relationship to the other of the first and second conductor plies by the transverse touch force, each juxtaposed stacked touch switch being electrically isolated from the remaining touch switches, at least one of the first and second conductor plies of at least one of the juxtaposed stacked switches comprising a conductor layer and a semiconductor composition layer having a thickness less than about 0.001 inches covering the conductor layer wherein the semiconductor composition layer faces the other of the first and second conductor plies for being contacted thereby when the transverse touch force is applied to close the juxtaposed stacked switches.

6. The multi-function, touch switch apparatus of claim 5 wherein the semiconductor composition layers are responsive to variations in the applied transverse touch force for decreasing the contact resistance across the surface of the semiconductor composition layer as the transverse touch force is increased.

* * * * *